United States Patent [19]

Wineburner

[11] 4,125,034

[45] Nov. 14, 1978

[54] LEVER MECHANISM

[75] Inventor: Ronald E. Wineburner, Pekin, Ill.

[73] Assignee: Caterpillar Tractor Co., Peoria, Ill.

[21] Appl. No.: 815,384

[22] Filed: Jul. 13, 1977

[51] Int. Cl.[2] ..... G05G 9/04

[52] U.S. Cl. ..... 74/471 XY; 137/636.2

[58] Field of Search ..... 74/471 R, 471 XY, 25, 74/54, 53, 55, 107, 559, 567, 569, 469, 473, 491; 137/636, 636.1, 636.2

[56] References Cited

U.S. PATENT DOCUMENTS

| | | | |
|---|---|---|---|
| 2,691,080 | 10/1954 | Kellogg | 74/471 R X |
| 2,967,436 | 1/1961 | Steinlein | 74/471 R |
| 3,530,736 | 9/1970 | Houk | 74/471 R X |
| 3,541,876 | 11/1970 | Gressard | 74/471 R |
| 4,028,958 | 6/1977 | Schrermann et al. | 74/471 XY |

*Primary Examiner*—Roy D. Frazier
*Assistant Examiner*—Terrell P. Lewis
*Attorney, Agent, or Firm*—Phillips, Moore, Weissenberger, Lempio & Majestic

[57] ABSTRACT

A single-control lever mounted in a pivot assembly is movable in an arc in first and second directions in one plane to impart motion through a cam arrangement to a first push rod and cable assembly so that the first push rod and cable assembly moves equal amounts in the same direction upon movement of the lever in either the first or second direction. The same single-lever is movable in an arc in third and fourth directions in a second plane normal to the first plane to impart longitudinal motion to a second push rod and cable assembly affixed to the pivot assembly. A plate member affixed to the bracket supporting the pivot assembly limits travel of the single-control lever to a predetermined path.

4 Claims, 4 Drawing Figures

LEVER MECHANISM

BACKGROUND OF THE INVENTION

This invention relates to a lever mechanism which may be affixed to a plurality of valve stems by appropriate cable and push rod assemblies for control thereof. In particular, it relates to a single-control lever mounted in a bracket assembly which has generally linear travel to control at least two valve stems in a construction machine.

Control of hydraulic circuits in machinery, particularly construction machinery of the mobile type, for example, tracked vehicles, is generally accomplished through lever mechanisms. Operation of these various lever mechanisms is best accomplished with a minimum change of directions of the lever during positioning in the various operable positions. For example, in a tracked vehicle having a winch mechanism affixed to the rearward end of the vehicle it is appropriate to provide control of the winch by fore and aft movement of the winch control lever. Simple fore and aft control motion is more appropriate than combined lateral and fore and aft motion for winch control in that the operator may observe the particular load being winched into or away from the winching vehicle. To utilize the more conventional and somewhat complex winching patterns for control of a plurality of valve stems associated with such a winch mechanism tends to divert the operator's attention from the job at hand.

A problem associated with a single-control lever in such a winching system is the necessity of controlling a plurality of valve stems. In any winching system, it is appropriate to select the direction the winch is to be rotated and secondly, to control the fluid rate delivered to the winch in order to control the speed of the winch and concurrently release any brake associated with the winch. Thus, a control lever must first select the direction of rotation of the winch, release the winch brake, and then finally, modulate fluid flow to the winch motor in accord with the desired rate of speed. To accomplish this in a two-directional (i.e., reel-in and reel-out) lever mechanism requires a particularly unique design since modulation control must be operable in both the reel-in and reel-out criteria.

Although this problem has been described in relation to a winch operation, it should be apparent to those skilled in the art that a single-control lever to control a plurality of valve stems is not unique to the winch problem. Accordingly this invention is equally applicable to other hydraulic control systems.

SUMMARY OF THE INVENTION

This present invention is directed to overcome one or more of the problems as set forth above.

Broadly stated, the invention is a lever mechanism comprising a bracket and a lever. The lever is pivotally mounted on the bracket for allowing limited rotational movement of the lever relative the bracket in first and second normally oriented planes. A first rod is also associated with the bracket and is movable longitudinally relative the bracket. Camming means are affixed to the pivot means and are responsive to rotational movement of the lever in the first plane for urging the first rod in first and second longitudinal directions. A second rod is associated with the pivot and is responsive to rotational movement of the lever in the second plane for longitudinal movement of the second rod relative the bracket.

DETAILED DESCRIPTION OF THE PREFERRED EMBODIMENT

This invention is described in relation to a winch control lever for operating a winch 6 mounted on a vehicle such as a tractor 7. It is to be understood that the lever mechanism described herein is equally applicable for use on other vehicles and for control of other hydraulic devices and the like.

Figure 2:
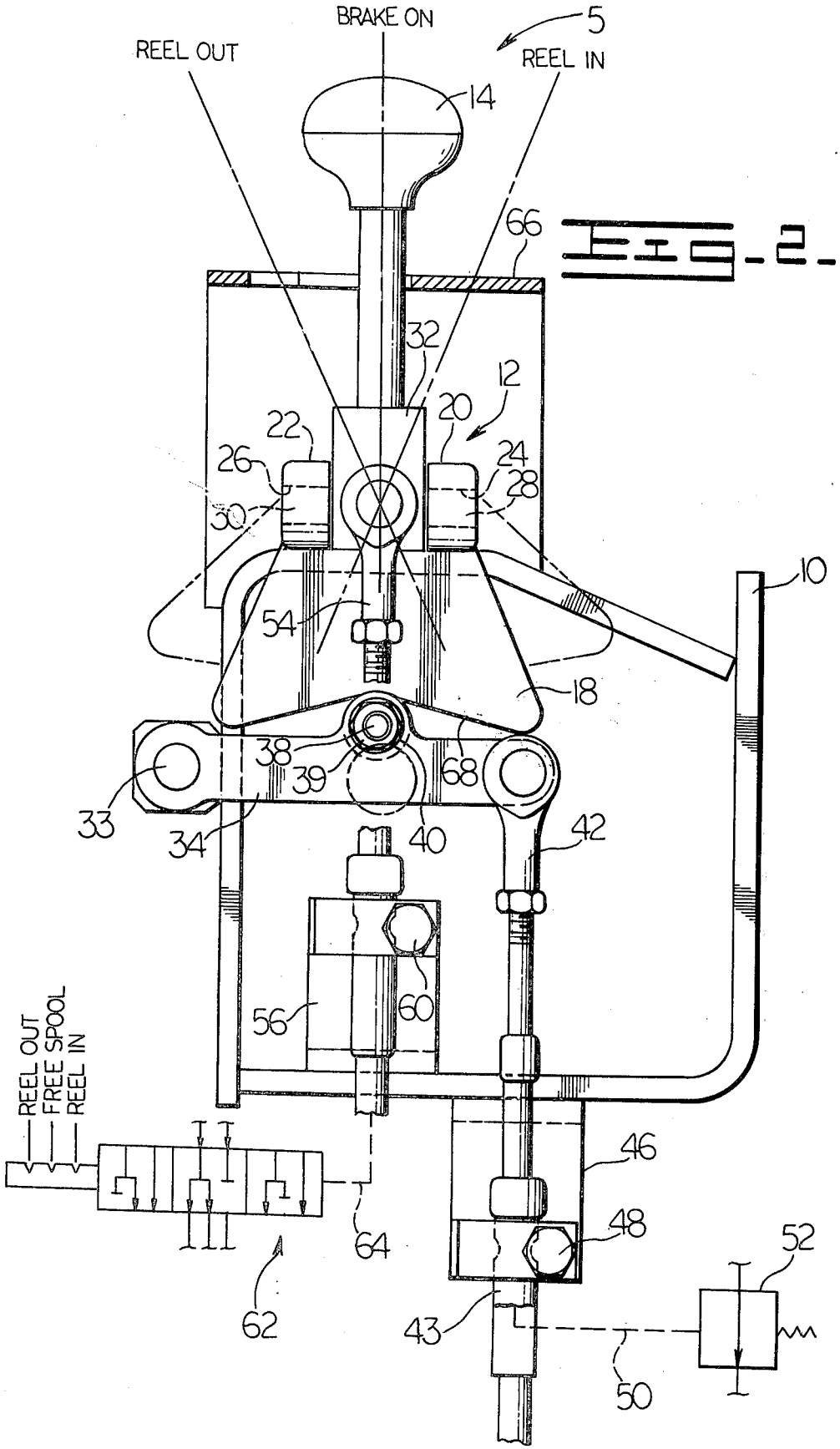
FIG. 2 is an elevation view partly in section and partly schematically of the lever mechanism that is the subject of this invention.

Referring to FIG. 2, lever mechanism 5 is shown in elevation and partly in section, with a schematic arrangement of valves which could be appropriate for control of winch 6. The various clutches and brakes necessary for operation of winch 6 beyond the valving structures are not herein shown as these clutches and brakes are well known in the art.

A bracket assembly 10 forms the basis for mounting of the lever mechanism 5 to vehicle 7. Bracket assembly 10 may be tailored to the specific needs of the vehicle; however, it must be formed to receive a gimbel arrangement, such as pivot means 12, to allow arcuate movement of a lever 14 affixed thereto in at least two planes. These planes are coincident with the planes of the drawing in FIG. 2 and FIG. 3, and are substantially normal one to the other. Pivot means 12 is comprised of a first member 16 (see FIG. 3) which is journalled for rotation in bracket assembly 10 and has subtending therefrom at one end a cam plate 18. Affixed to first member 16 is a bifurcated element comprising two axially bored bearing members 20 and 22, each extending outwardly of first member 16 and each defining a bore 24 and 26, respectively, which form gudgeons or journals for the outwardly extending trunions 28 and 30 formed on a second member such as pivot block 32 to which lever 14 is affixed. It should be apparent to those in the art that lever 14 is effectively gimbaled relative bracket assembly 10 and may be rotated with rotational freedom.

Also affixed to bracket assembly 10 by appropriate bearing means, such as a journalled shaft 33, is a cam lever 34. Cam lever 34 is affixed at one end as previously noted by journal shaft 33 to the bracket assembly 10, and carries proximate the midpoint thereof a cam roller 36, which is associated with cam lever 34 by means of a shaft 38. Shaft 38 may be affixed to cam lever 34 by appropriate fastening means, such as a nut 39 threadably engaged on shaft 34 and having disposed between nut 39 and cam lever 34 a locking member, such as lock washer 40. It is to be understood that cam roller 36 is free to rotate on shaft 38 to reduce frictional forces between cam roller 36 and cam surface 68 of cam plate 18. Cam roller 36 is for engagement with this lower surface cam surface 68 of cam plate 18 to act under the influence thereof. Such influence will cause an arcuate movement of cam lever 34 as a result of arcuate movement of lever 14 in the plane illustrated by rightward and leftward motion in FIG. 2.

Affixed at the end of cam lever 34 may be a push rod 42. Push rod 42 reciprocates in a housing member 43 rigidly affixed to bracket assembly 10 by appropriate means well known in the art, such as subtending bracket 46 and locking member 48. Appropriate link means 50 may then interconnect push rod 42 with a modulating type valve 52 or the like wherein either system pressure or flow rate is to be controlled relative a second valve. Modulating valve 52 may also serve to bias cam lever 34 upwardly as shown in FIG. 2.

Affixed to pivot block 32 is a second push rod 54 which is also fixedly associated with bracket 10 by means of a second bracket 56 rigidly affixed to bracket 10. A housing 58 is associated with bracket 56 by locking member 60. Push rod 54 is associated with housing 58 so that reciprocation may take place therethrough to operate a linkage means 64 and a 3-position valve such as valve means 62, which may control the rotational direction of a hydraulically operated winch motor (not shown).

Figure 1:
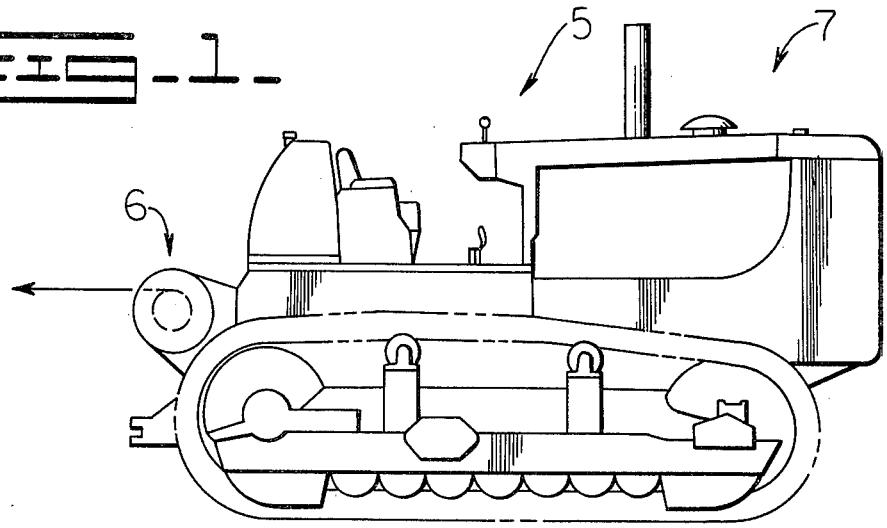
FIG. 1 is an elevation view of a construction vehicle in which the present invention could be used.
Figure 4:
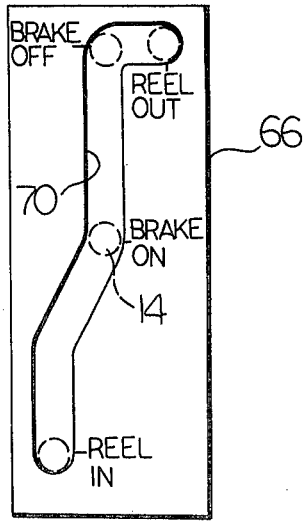
FIG. 4 is a plan view of the console plate utilized in this invention.

Affixed to bracket 10 is a console plate 66 which is slotted as shown in FIG. 4 to limit travel of lever 14 to a particular pattern for control of the aforedescribed winch. It is to be understood that the slotted pattern of console plate 66 may be modified for use in other installations. The pattern depicted here is particularly adaptable to the winch control of this invention.

Operation of the lever mechanism described here should be apparent to those skilled in the art; however, in order to clarify the design and the operation, the following description is offered in elaboration. It is to be understood that the primary advantage of this particular camming arrangement is to insure that push rod 42 is moved downwardly as shown in FIG. 2 the same relative amount no matter in which direction in the plane of FIG. 2 that lever 14 is rotated in. In the environment herein described, rotation of lever 14 in the counterclockwise direction as shown in FIG. 2 may accomplish a reel-out condition in the associated hydraulic winch motor, while rotation in the clockwise direction from the center position as shown in FIG. 2 will accomplish a reel-in capability. Specifically, the greater the movement from the center position wherein the lever rests in FIG. 2, the faster the hydraulic motor operating winch 6 will rotate. The position lever 14 has taken in FIG. 2 in the "brake-on" or stop position. Thus, motion of push rod 42 is accomplished through the cam plate 18 which defines the concave cam surface 68 so that movement of lever 14 urges cam roller 36 downwardly as illustrated in FIG. 2 along the cam surface 68 with the movement of cam roller 36 being proportional to the displacement of lever 14 in either direction from the neutral position as illustrated in FIG. 2.

Figure 3:
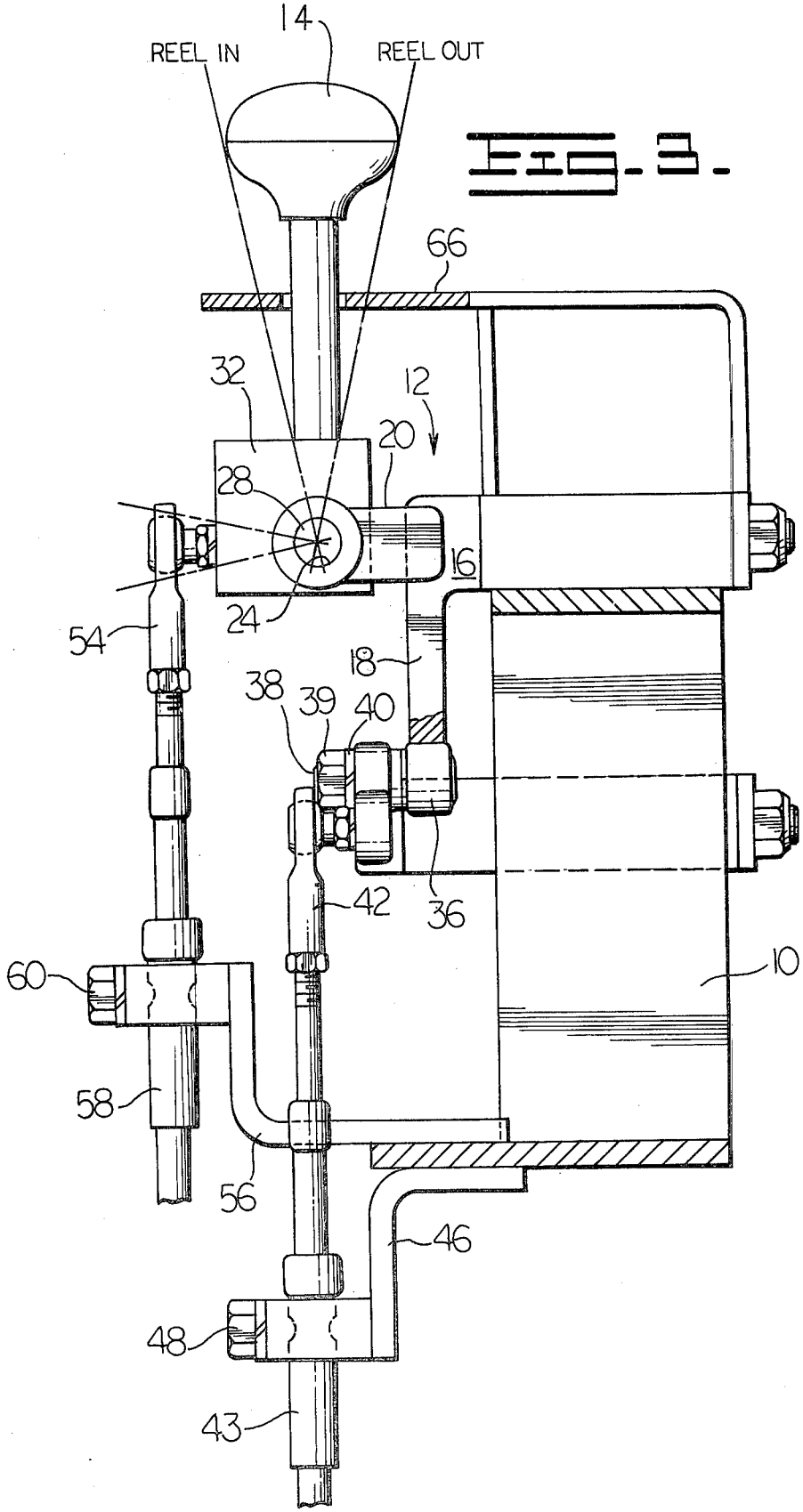
FIG. 3 is the lever mechanism as shown in FIG. 2, also partly in section and taken at a side elevation.

Concurrently, movement of lever 14 in the plane of FIG. 3 will reciprocate push rod 54 relative housing 58 and, thus, displace the valve stem of valve means 62 appropriately. In order to accomplish the necessary control of the hydraulic winch, the valve could have a minimum of three positions to obtain the steps of a "brake-on" position, a "reel-out" position, and, finally, a "reel-on" position. This should be apparent to those well versed in the art. However, it is necessary to control the movement of lever 14 so that displacement in the clockwise direction as indicated in FIG. 2 may first release the brake and then accomplish the reel-in capability of the associated winch. Such a valving structure is shown in more detail in U.S. Pat. No. 3,729,171, issued Apr. 24, 1973. Similarly, movement in the counterclockwise direction shown in FIG. 2 must first release the brake and then accomplish the reel-out capability. Reference should be made to FIG. 4 wherein lever 14 would appear in the slot 70 and would thus follow the slot 70. It can be seen as lever 14 is moved downwardly to the position marked "reel-in" in FIG. 4, lever 14 will rotate in the plane of paper 3 and thus position the valve stem of valve 62 to the appropriate "reel-in" position with modulation occurring through the motion of cam roller 36 following cam surface 68. Similarly, motion in the upward direction from the position shown in FIG. 4 will first release the winch brake; that is, full modulation may occur in valve member 52 which could accomplish both the brake-off and the full speed operation of the hydraulic motor before shifting of the valve stem in valve means 62. Such motion could be used for a free-wheeling condition. It should be apparent to those in the art that a duplicate pattern could be repeated in the "brake-off," "reel-out" mode as indicated in the "reel-in" mode in FIG. 4.

Although this invention has been described in reference to a particular embodiment for control of a winch in a construction vehicle, it is to be understood that other applications are equally appropriate. It is to be further understood that this invention is limited only by the appended claims.

Embodiments of the invention in which an exclusive property or privilege is claimed are defined as follows:

1. A lever mechanism comprising:

a bracket;

a lever;

pivot means mounting said lever on said bracket for allowing rotational movement of said lever relative said bracket in first and second normally oriented planes;

a first push rod associated with said bracket and movable longitudinally relative said bracket;

a cam plate associated with said pivot means and defining a cam surface of a predetermined pattern;

an arm having a first and second end, said arm pivotally mounted at said first end to said bracket, said first push rod pivotally affixed to said second end of said arm;

a cam follower associated with said arm intermediate said first and second ends for following said cam surface;

said cam surface imparting motion to said first push rod in the same direction and at the same rate upon movement of said lever in opposite directions in said first plane;

second push rod means associated with said bracket and responsive to rotational movement of said lever in said second plane for movement of said second push rod means in first and second longitudinal directions relative said bracket; and a slotted plate associated with said bracket for limiting movement of said lever to a predetermined pattern.

2. The lever mechanism of claim 1 wherein said pivot means comprises a first member pivotally associated with the bracket for rotation about a first axis in the first plane relative said bracket and a second member pivotally mounted on said first member for rotation about a second axis normal to said first axis and lying in the second plane;

and further, wherein the cam plate is affixed to said first member and the second push rod means is associated with said second member.

3. The lever mechanism of claim 2 wherein the lever is fixedly associated with the second member.

4. The lever mechanism of claim 3 wherein the first member is bifurcated and further wherein said second member is mounted for rotation between the bifurcated portions of said first member.

* * * * *